US011389977B2

(12) United States Patent
Lap et al.

(10) Patent No.: US 11,389,977 B2
(45) Date of Patent: Jul. 19, 2022

(54) SHAVING SYSTEM WITH SHAVING DEVICE AND CLEANING DEVICE

(71) Applicant: KONINKLIJKE PHILIPS N.V., Eindhoven (NL)

(72) Inventors: Reinder Niels Lap, Surhuizum (NL); Ernst Hupkes, Kampen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 17/286,510

(22) PCT Filed: Dec. 10, 2019

(86) PCT No.: PCT/EP2019/084296
§ 371 (c)(1),
(2) Date: Apr. 19, 2021

(87) PCT Pub. No.: WO2020/120421
PCT Pub. Date: Jun. 18, 2020

(65) Prior Publication Data

US 2021/0354319 A1 Nov. 18, 2021

(30) Foreign Application Priority Data

Dec. 13, 2018 (EP) ..... 18212480

(51) Int. Cl.
*B26B 19/38* (2006.01)
*B26B 19/14* (2006.01)
(Continued)

(52) U.S. Cl.
CPC ..... *B26B 19/3833* (2013.01); *A45D 27/46* (2013.01); *B26B 19/141* (2013.01); *B26B 19/282* (2013.01); *B26B 21/40* (2013.01)

(58) Field of Classification Search
CPC ..... B26B 19/3833; B26B 19/141; B26B 19/282; B26B 21/00; B26B 21/40;
(Continued)

(56) References Cited

U.S. PATENT DOCUMENTS 5,711,328 A * 1/1998 Braun ..... A45D 27/46 134/116
6,371,136 B1 * 4/2002 Hoser ..... A45D 27/46 134/201
(Continued)

FOREIGN PATENT DOCUMENTS

CN 1721146 1/2006
EP 2233031 9/2010
(Continued)

OTHER PUBLICATIONS

International Search Report and Written Opinion dated Feb. 14, 2020 for International Application No. PCT/EP2019/084296 Filed Dec. 10, 2019.

*Primary Examiner* — Phong H Nguyen

(57) ABSTRACT

A shaving system comprising a shaving device and a cleaning device (14) is disclosed, wherein the shaving device comprises a main housing and a shaving unit coupled to the main housing, wherein the main housing accommodates an electric actuator and a first drive unit drivable by the electric actuator, the shaving unit comprising at least one hair-cutting unit and a second drive unit coupled to the first drive unit and to the hair-cutting unit such that the hair-cutting unit is drivable by the electric actuator via the first and second drive units; wherein the cleaning device (14) comprises a supporting structure (15) for supporting the shaving device, and a receiving space (28) for receiving the shaving unit when the shaving device is arranged in a cleaning position supported by the supporting structure (15); and wherein the cleaning device (14) comprises a reservoir (32) for containing a cleaning liquid and a fluid pumping unit (48) for transporting the cleaning liquid from the reservoir (32) to the
(Continued)

receiving space (28); wherein the shaving device comprises a driving coupling member which is accessible from an outside of the shaving device and drivable by the shaving device; wherein the cleaning device (14) comprises a driven coupling member (30) which is accessible from an outside of the cleaning device (14), and a third drive unit (50) coupled to the driven coupling member (30) and to the fluid pumping unit (48) such that the fluid pumping unit (48) is drivable by the driven coupling member (30); and wherein the driving coupling member and the driven coupling member (30) are arranged such that, in the cleaning position of the shaving device, the driven coupling member (30) is coupled to the driving coupling member such that the fluid pumping unit is drivable by the driving coupling member.

17 Claims, 9 Drawing Sheets

(51) Int. Cl.

| | |
|---|---|
| ***B26B 19/28*** | (2006.01) |
| ***B26B 21/40*** | (2006.01) |
| ***A45D 27/46*** | (2006.01) |

(58) Field of Classification Search
CPC ..... B26B 21/4012; B26B 21/4068; B26B 21/4075; A56D 27/46
USPC ..... 30/537; 134/111, 135, 184
See application file for complete search history.

(56) References Cited

U.S. PATENT DOCUMENTS

| | | | | |
|---|---|---|---|---|
| 7,521,820 | B2 | 4/2009 | Kitamura | |
| 2006/0042103 | A1 | 3/2006 | Chasen | |
| 2009/0019702 | A1* | 1/2009 | Wevers | A45D 27/46 30/41.5 |
| 2011/0220156 | A1* | 9/2011 | Kooijker | A45D 27/46 134/34 |

FOREIGN PATENT DOCUMENTS

| | | |
|---|---|---|
| WO | 2004/080235 | 9/2004 |
| WO | 2004/086901 | 10/2004 |
| WO | 2006/018745 | 2/2006 |

* cited by examiner

SHAVING SYSTEM WITH SHAVING DEVICE AND CLEANING DEVICE

CROSS REFERENCE TO RELATED APPLICATIONS

This application is the U.S. National Phase application under 35 U.S.C. § 371 of International Application No. PCT/EP2019/084296 filed Dec. 10, 2019, which claims the benefit of European Patent Application Number 18212480.0 filed Dec. 13, 2018. These applications are hereby incorporated by reference herein.

FIELD OF THE INVENTION

The present invention relates to a shaving system comprising a shaving device and a cleaning device for the shaving device.

The invention further relates to a cleaning device for use in such a shaving system.

The invention further relates to a shaving device for use in such a shaving system.

BACKGROUND OF THE INVENTION

From WO 2004/086901 A1 a shaving system comprising a shaving device and a cleaning device is known, wherein:

the shaving device comprises a main housing and a shaving unit coupled to the main housing, wherein the main housing accommodates an electric actuator and a first drive unit drivable by the electric actuator, the shaving unit comprising at least one hair cutting unit and a second drive unit coupled to the first drive unit and to the hair-cutting unit such that the hair-cutting unit is drivable by the electric actuator via the first and second drive unit;

the cleaning device comprises a supporting structure for supporting the shaving device, and a receiving space for receiving the shaving unit when the shaving device is arranged in a cleaning position supported by the supporting structure; and the cleaning device comprises a reservoir for containing a cleaning fluid and a fluid pumping unit for transporting the cleaning liquid from the reservoir to the receiving space.

In the known shaving system the shaving device can be supported upside down within a support of the cleaning device that can be manually moved downwardly so that the shaving unit enters into a reservoir into which a cleaning fluid from a reservoir can be pumped using an external manually operated pumping system.

Such a shaving system is advantageous for keeping a hygienic shaving device so that a clean shaving unit can be used for the next shave. The cleaning of the shaving unit is also beneficial for maintenance of the system.

The utilization of a dedicated cleaning device according to WO 2004/086901 A1 is not convenient for the user, because the pumping unit of the cleaning device must be driven manually.

WO 2004/080235 A1 discloses a shaving system comprising a shaving device and a cleaning device, wherein the cleaning device comprises an electric fluid pumping unit having an electric pump for transporting the cleaning liquid from the reservoir to the receiving space. The presence of the electric pump in the cleaning device and the electric components required for the control of the pump and for the supply of electric power to the pump increase the complexity and costs of the shaving system.

According to CN 1721146 A another shaving system is known that comprises a shaving device and a dedicated cleaning device. To avoid a separate pump unit within the cleaning device the shaving device itself further comprises a pump unit, that can be used for pumping a cleaning fluid, when the shaving device is placed on a suitable supporting structure of the cleaning device. Such a structure has the disadvantage that the shaving device itself becomes more bulky and increases in weight, due to the pumping unit that is included within the shaving device.

SUMMARY OF THE INVENTION

In view of this it is an object of the present invention to disclose a shaving system including a shaving device and a cleaning device that allows for cleaning of the shaving device in a simple, cost-effective and convenient manner. An increase in weight of the shaving device should preferably be avoided or kept as small as possible.

According to a first aspect of the present invention, a shaving system as mentioned here before is characterized in that:

the shaving device comprises a driving coupling member which is accessible from an outside of the shaving device and drivable by the shaving device;

the cleaning device comprises a driven coupling member which is accessible from an outside of the cleaning device, and a third drive unit coupled to the driven coupling member and to the fluid pumping unit such that the fluid pumping unit is drivable by the driven coupling member; and the driving coupling member and the driven coupling member are arranged such that, in the cleaning position of the shaving device, the driven coupling member is coupled to the driving coupling member such that the fluid pumping unit is drivable by the driving coupling member.

According to the invention the fluid pumping unit of the cleaning device is driven by the shaving device without the necessity of an independent electrically powered drive unit within the cleaning device. In this way also an independent voltage source for the cleaning device is dispensed with. The shaving system thus is designed in a very simple and cost-effective way, and can also by conveniently used. The shaving device itself merely needs to include a driving coupling member that is drivable by the shaving device. In this respect, the expression "drivable by the shaving device" means that the driving coupling member is driven by an actuator arranged in the shaving device. Said actuator can be the main electric actuator of the shaving device that can drive the shaving unit or a separate actuator arranged in the shaving device to drive the driving coupling member. Since the driving coupling member is coupled to a driven coupling member provided on the cleaning device when the shaving device is placed on the cleaning device in a cleaning position, there is no need for an extra pumping unit that is included within the shaving device. The driving coupling member can be arranged in any suitable position on the shaving device, e.g. on the shaving unit or on the main housing, such that the driving coupling member engages the driven coupling member of the cleaning device when the shaving device is in the cleaning position supported by the supporting structure of the cleaning device. In an embodiment wherein the driving coupling member is driven by the main electric actuator which also drives the shaving unit, no increase or only a small increase in weight of the shaving device is achieved.

A particular advantage of the shaving system according to the invention rests in the fact that the cleaning device does not need any active motor or electronics for obtaining a suitable cleaning operation. Instead, the necessary drive for the pumping unit is derived from the drive system of the shaving device. Also a control for automatically controlling a cleaning operation can be included within the shaving device.

In a preferred embodiment of the shaving system according to the invention, the driving coupling member is drivable by the electric actuator.

In this way the electric actuator used to drive the shaving unit is also used for driving the driving coupling member.

In a further embodiment of the shaving system according to the invention, the driving coupling member in the shaving device is driven by a separate motor/actuator.

In another embodiment of the shaving system according to the invention, the driving coupling member is arranged in the shaving unit and coupled to the second drive unit such that the driving coupling member is drivable by the electric actuator via the first and second drive units.

This results in a very practical and cost effective position of the driving coupling member.

In a further embodiment of the shaving system according to the invention, the shaving unit comprises at least two hair-cutting units each having an external cutting member and an internal cutting member which is rotatable relative to the external cutting member, and the driving coupling member is arranged centrally between the at least two hair-cutting units.

In this way the driving coupling member can be coupled to the second drive unit in a very simple way without substantially changing the design of the shaving unit itself.

In another embodiment of the shaving system according to the invention, the shaving unit comprises three hair-cutting units each having an external cutting member and an internal cutting member which is rotatable relative to the external cutting member, wherein the three hair-cutting units are mutually arranged in a triangular configuration and wherein the driving coupling member is arranged centrally between the three hair-cutting units.

In this way the advantageous triangular configuration of the three hair-cutting units, that has been used in shaving devices since a long time, can be employed, while keeping the design changes to the shaving unit as small as possible.

In another embodiment of the shaving system according to the invention, the driving coupling member is only drivable when the shaving device is in the cleaning position.

In this way movement of the driving coupling member, which is accessible from the outside of the shaving device, is avoided when the shaving device is used in a regular shaving operation. In alternative embodiments wherein the driving coupling member is also driven during a regular shaving operation, in particular continuously driven, the moving driving coupling member can be prevented from interfering with the normal shaving operation, in particular from touching the skin during the normal shaving operation, by arranging the driving coupling member in a recessed position between the hair-cutting units.

In another embodiment of the shaving system according to the invention, the shaving device comprises a control unit configured and arranged for controlling the driving of the driving coupling member according to a driving program.

In this way a suitable control of the cleaning operation can be obtained via the driving program. There is no need to include any control unit within the cleaning device, since the control unit already included within the shaving device to control the normal shaving operation can be used to control the operation of the cleaning device by controlling the driving of the driving coupling member.

In a further embodiment of the shaving system according to the invention, the shaving device comprises a user interface coupled to the control unit by means of which a user of the shaving system can activate the driving program.

In this way, to effect a cleaning of the shaving device, the user can start the driving program via the user interface provided on the shaving device.

In an alternative embodiment of the shaving system according to the invention, the shaving device comprises a detector coupled to the control unit for detecting the cleaning position, and the control unit is configured and arranged to activate the driving program after detection of the cleaning position by the detector.

This allows for an automatic start-up of the driving program when the shaving device is placed on the supporting structure of the cleaning device. This is very convenient, since the user merely has to place the shaving device correctly on the supporting structure, as a result of which the cleaning procedure is started automatically.

According to a second aspect of the invention, a cleaning device for use in a shaving system according to the invention as described here before is disclosed, wherein the cleaning device comprises:

a supporting structure for supporting a shaving device;

a receiving space for receiving a shaving unit of the shaving device when the shaving device is arranged in a cleaning position supported by the supporting structure; and a reservoir for containing a cleaning liquid and a fluid pumping unit for transporting the cleaning liquid from the reservoir to the receiving space;

wherein the cleaning device further comprises a driven coupling member and a drive unit coupled to the driven coupling member and to the fluid pumping unit such that the fluid pumping unit is drivable by the driven coupling member, and wherein the driven coupling member is accessible from an outside of the cleaning device.

Thus, in a cleaning device according to the invention, the fluid pumping unit of the cleaning device can be driven by an external device via the driven coupling member provided on the cleaning device, so that an electric actuator in the cleaning device for driving the fluid pumping unit can be avoided.

In a preferred embodiment of the cleaning device according to the invention, the driven coupling member is accessible and arranged such that, in the cleaning position of the shaving device, the driven coupling member is coupled to a driving coupling member of the shaving device such that the fluid pumping unit is drivable by the driving coupling member.

In this embodiment the fluid pumping unit of the cleaning device can be driven by a shaving device, when the shaving device is in the cleaning position within the cleaning device.

In another embodiment of the cleaning device according to the invention, the driven coupling member is arranged in the receiving space.

This allows for a very practical position of the driven coupling member such that, when the shaving unit of the shaving device is placed within the receiving space, a coupling between the driven coupling member and the driving coupling member can be effected in a practical way.

In another embodiment of the cleaning device according to the invention, the driven coupling member is arranged centrally in a bottom wall of the receiving space.

This position of the driven coupling member allows an easy and practical coupling of the driven coupling member with the driving coupling member of a shaving device by arranging the driving coupling member centrally on the shaving unit.

In a further embodiment of the cleaning device according to the invention, the reservoir is replaceable.

To this end, preferably the cleaning device comprises a lower housing portion and an upper housing portion detachably coupled to the lower housing portion, wherein the reservoir is arranged in the lower housing portion and accessible for replacement by removing the upper housing portion from the lower housing portion, and wherein the supporting structure, the receiving space, the driven coupling member and the fluid pumping unit are arranged in the upper housing portion.

In this way a replaceable reservoir for the cleaning fluid can be used and introduced into and removed from the cleaning device in a very simple manner.

In another embodiment of the cleaning device according to the invention, the drive unit and the fluid pumping unit are arranged in the upper housing portion.

In this way a replaceable reservoir that can be easily replaced can be integrated in the lower housing portion in a simple way.

In another embodiment of the cleaning device according to the invention, the reservoir is integrally formed with the cleaning device.

In this way a separate replaceable reservoir is avoided. Instead the complete cleaning device may be offered as a low-cost consumer replaceable part of a shaving system comprising the cleaning device and a shaving device. This is possible in a cost-effective manner, since the cleaning device does not contain any electric motor or electronics for driving the fluid pumping unit.

According to a third aspect of the invention, a shaving device for use in a shaving system according to the invention as described here before is disclosed, wherein the shaving device comprises a main housing and a shaving unit coupled to the main housing, wherein the main housing accommodates an electric actuator and a first drive unit drivable by the electric actuator, and wherein the shaving unit comprises:

at least two hair-cutting units each having an external cutting member and an internal cutting member which is rotatable relative to the external cutting member;

a second drive unit coupled to the first drive unit and to the at least two hair-cutting units such that the internal cutting members of the at least two hair-cutting units are drivable by the electric actuator via the first and second drive units;

wherein the shaving unit further comprises a driving coupling member which is coupled to the second drive unit such that the driving coupling member is drivable by the electric actuator via the first and second drive units, wherein the driving coupling member is arranged centrally between the at least two hair-cutting units such that the driving coupling member is accessible from an outside of the shaving unit.

The driving coupling member of the shaving device according to the invention is arranged in a practical position centrally on the shaving unit, so that it can be used in a practical way for driving an external device, such as a cleaning device for the shaving unit of the shaving device, by coupling the driving coupling member to said external device.

In an embodiment of the shaving device according to the invention, the driving coupling member is accessible for coupling to a driven coupling member of a cleaning device for the shaving unit when the shaving device is arranged in a cleaning position relative to the cleaning device.

In this embodiment, the driving coupling member is used to drive a cleaning device, for example a fluid pumping unit of the cleaning device, when the shaving device is in the cleaning position relative to the cleaning device. In the cleaning position, the driving coupling member of the shaving device is coupled to the driven coupling member of the cleaning device.

In another embodiment of the shaving device according to the invention, the shaving unit comprises three hair-cutting units each having an external cutting member and an internal cutting member which is rotatable relative to the external cutting member, wherein the three-hair-cutting units are mutually arranged in a triangular configuration and wherein the driving coupling member is arranged centrally between the three-hair-cutting units such that the driving coupling member is accessible from the outside of the shaving unit.

In this embodiment, the driving coupling member is integrated in a practical way in a shaving unit with three hair-cutting-units.

In another embodiment of the shaving device according to the invention, the shaving unit is coupled to the main housing by means of a coupling structure, and:

the second drive unit comprises a driving gear wheel which is centrally arranged relative to the at least two hair-cutting units to engage a respective driven gear wheel of each of the hair-cutting units;

the coupling structure accommodates a central drive shaft mutually coupling the driving gear wheel and the first drive unit;

the driving coupling member is connected to the driving gear wheel such as to be rotatable together with the driving gear wheel about a common axis of rotation.

In this embodiment, the driving coupling member can be directly mounted to the driving gear wheel of the second drive unit, which is anyhow required to transfer a driving torque of the central drive shaft to each of the at least two hair-cutting units. Thus the driving coupling member can be integrated into the shaving unit with a minimum number of additional constructional parts.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE EMBODIMENTS

Figure 1:
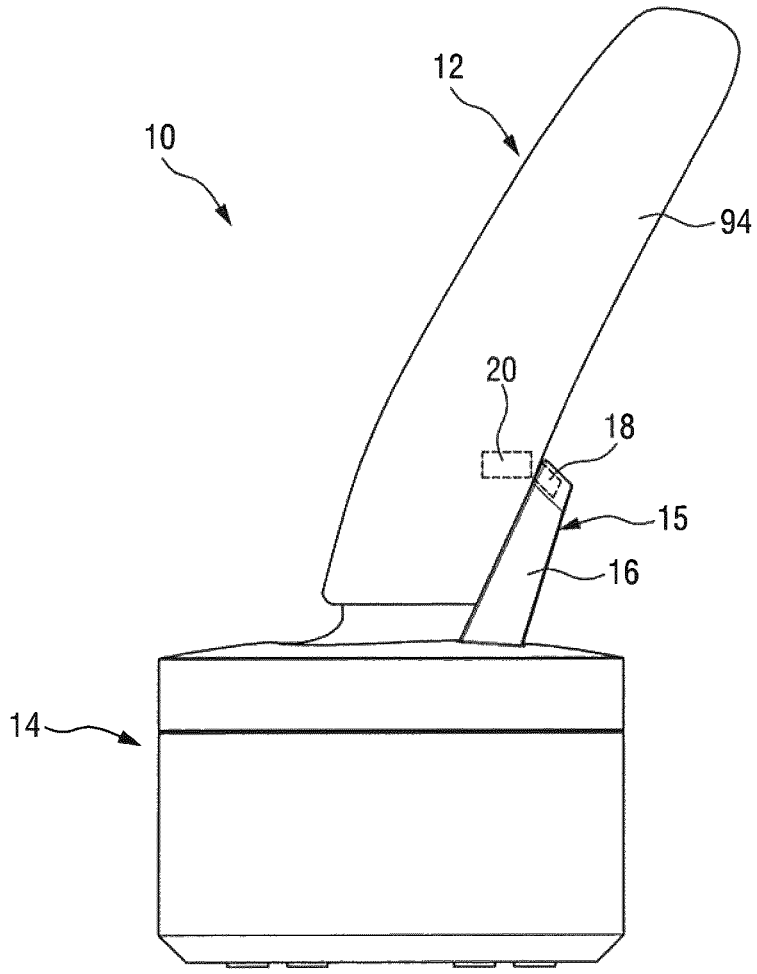
FIG. 1 shows a perspective view of a shaving system according to the invention, wherein a shaving device is placed on a support structure of a respective cleaning device.

FIG. 1 shows a shaving system according to the invention in perspective view which is designated in total with reference numeral 10. The shaving system 10 comprises a cleaning device 14 including a supporting structure 15, whereon a shaving device 12 can be placed in a cleaning position. The cleaning device 14 comprises a pot-shaped housing 22 (see FIG. 2). A rest 16 protrudes from the top of the housing 22. The rest 16 serves to support a main housing of the shaving device 12 when the shaving device 12 is placed on the support structure 15 as shown in FIG. 1.

FIG. 1 further schematically shows a detector 20 provided at the shaving device 12. The detector 20 cooperates with an associated detector activating means 18 provided on the rest 16. The detector activating means 18 may be for instance a permanent magnet that cooperates with a hall sensor serving as the detector 20 within the shaving device 12. Thus the detector 20 can detect whether the shaving device 12 is placed correctly in the cleaning position on the supporting structure 15.

Figure 2:
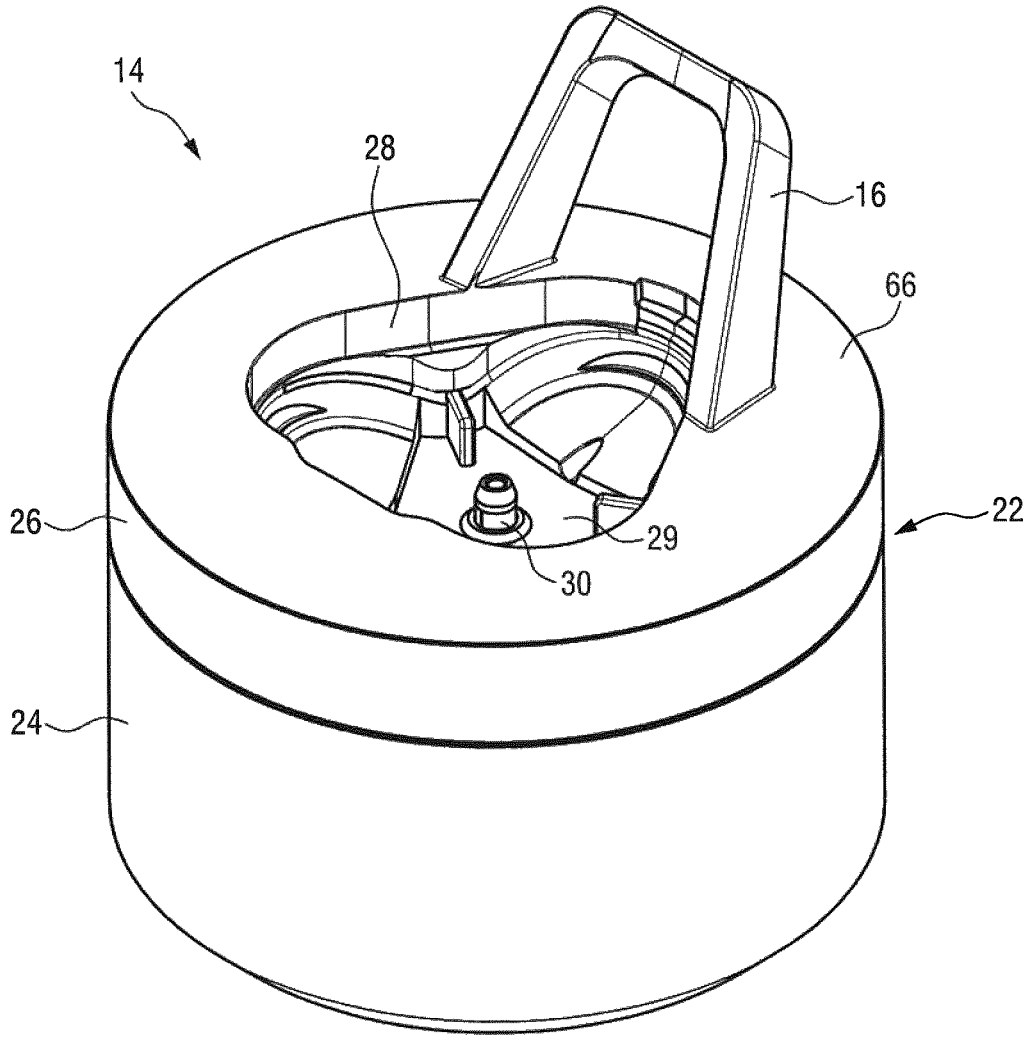
FIG. 2 shows an enlarged perspective view of the cleaning device of the shaving system of FIG. 1 without the shaving device.

FIG. 2 is an enlarged perspective representation of the cleaning device 14. The pot-shaped housing 22 comprises a lower housing portion 24 onto which an upper housing portion 26 is placed. The upper housing portion has a top wall 66, wherein a substantially triangular opening is formed that provides access to a receiving space 28 extending into the interior of the housing 22. The shape of the receiving space 28 corresponds to the shape of a respective shaving unit provided on the shaving device 12. When the shaving device 12 is placed with its shaving unit within the receiving space 28 as shown in FIG. 1, the main housing of the shaving device 12, which is in the shape of a handle, is supported by the rest 16.

In FIG. 2, in addition a driven coupling member 30 is shown that is provided in a central position of the receiving space 28 on the bottom wall 29 thereof. When the shaving device 12 is placed with its shaving unit within the receiving space 28 of the cleaning device 14, as shown in FIG. 1, then the driven coupling member 30 will be coupled with a respective driving coupling member provided on the shaving unit of the shaving device 12, as will be explained hereinafter.

Figure 3:
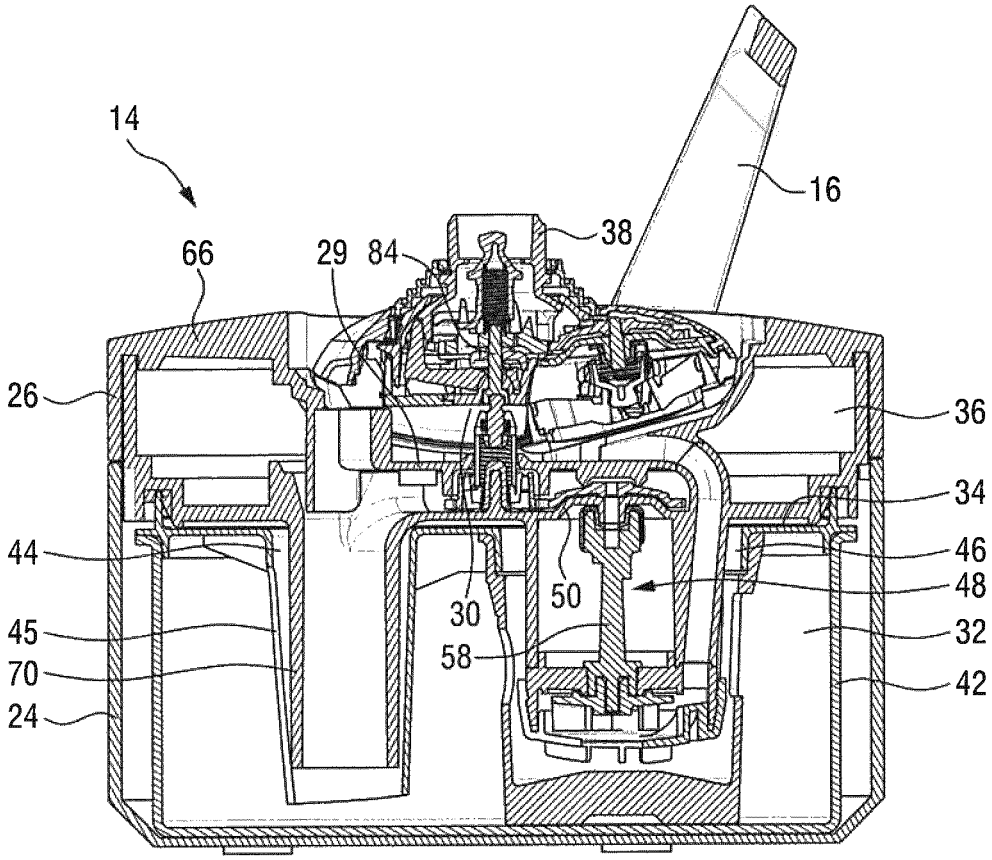
FIG. 3 shows a cross-section of the cleaning device of FIG. 2, wherein in addition the shaving unit of the shaving device is shown in a cleaning position within the cleaning device.

FIG. 3 is a cross-sectional representation of the cleaning device 14, wherein in addition the shaving unit 38 of the shaving device 12 is shown in a cleaning position within the respective receiving space 28.

Figure 4:
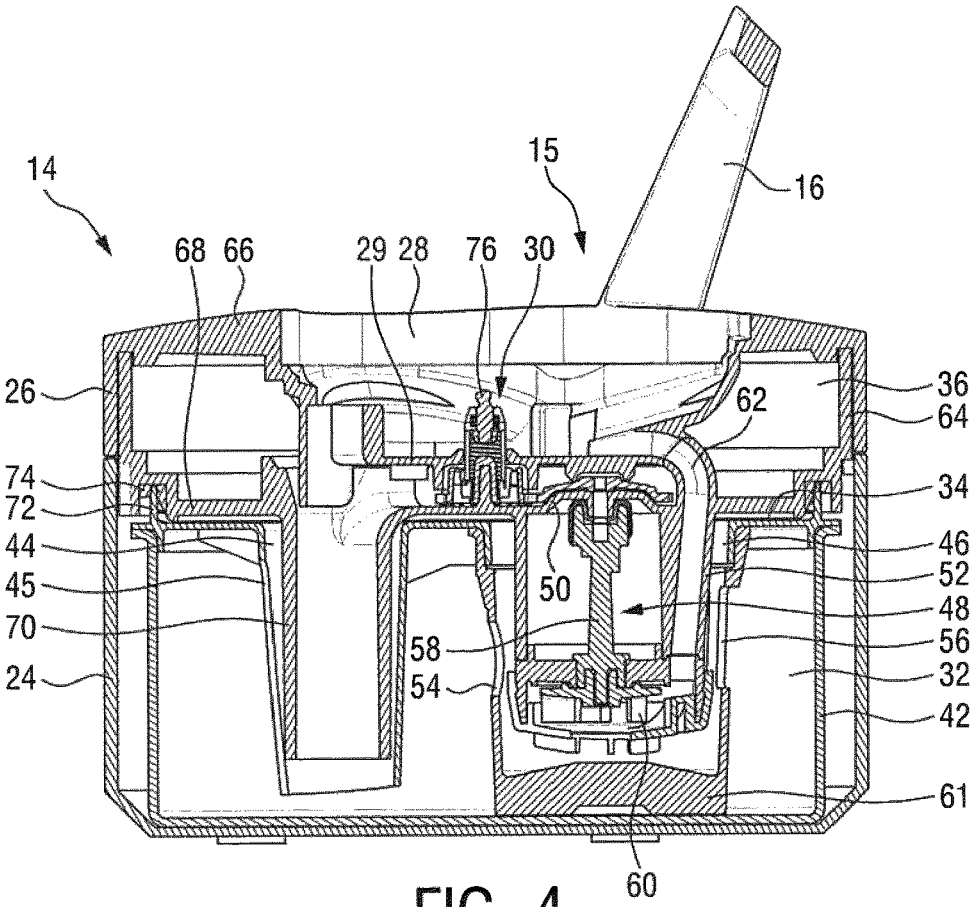
FIG. 4 shows the cross-sectional view according to FIG. 3, but without the shaving unit of the shaving device.
Figure 9:
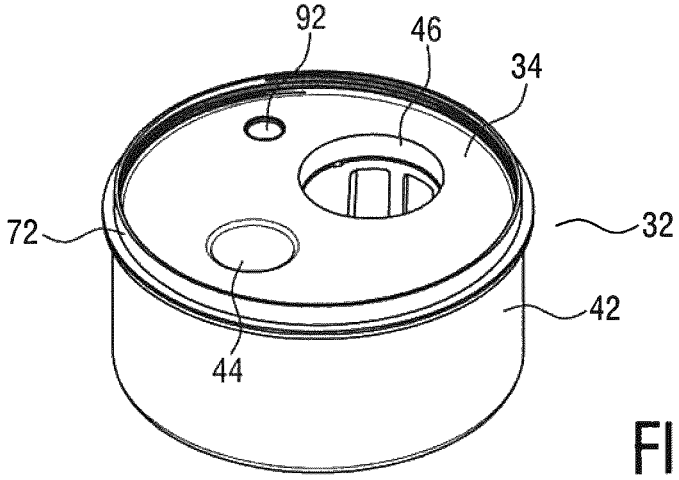
FIG. 9 shows a cartridge containing a cleaning fluid that can be introduced into a lower housing portion of the cleaning device of FIG. 1.

As can be seen in FIG. 4, the cleaning device 14 comprises the lower housing portion 24, onto which the upper housing portion 26 is placed. Within the lower housing portion 24 there is received a cartridge 32 (see also FIG. 9) that can be placed within the lower housing portion 24 when the upper housing portion 26 is removed. The cartridge 32 contains a cleaning liquid and can be provided as a separate consumer replaceable part, which the user can insert into the cleaning device 14 and which needs to be replaced usually after a certain number of cleaning operations.

Figure 8:
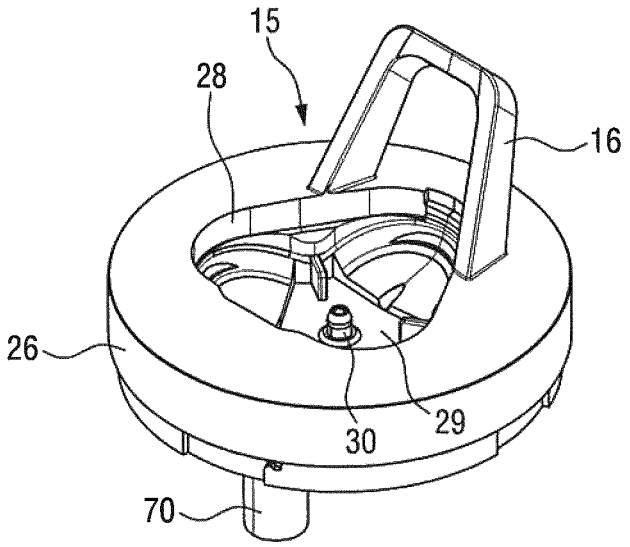
FIG. 8 shows a perspective view of an upper housing portion of the cleaning device of FIG. 1.
Figure 10:
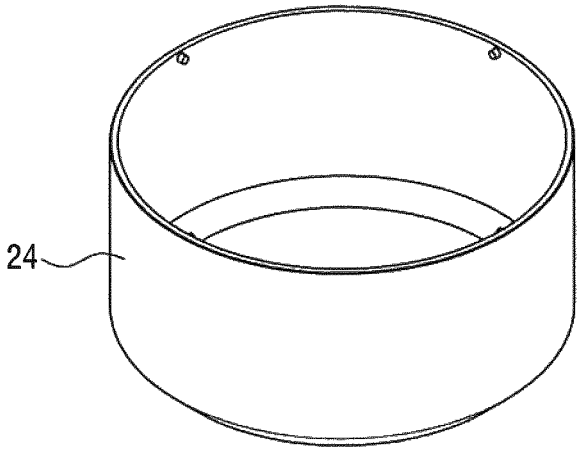
FIG. 10 shows a lower housing portion of the cleaning device of FIG. 1 with the cartridge and the upper housing portion removed.

In FIG. 8 the upper housing portion 26 is shown above the cartridge 32 (shown in FIG. 9) which can be placed within the lower housing portion 24 (shown in FIG. 10).

Figure 11:
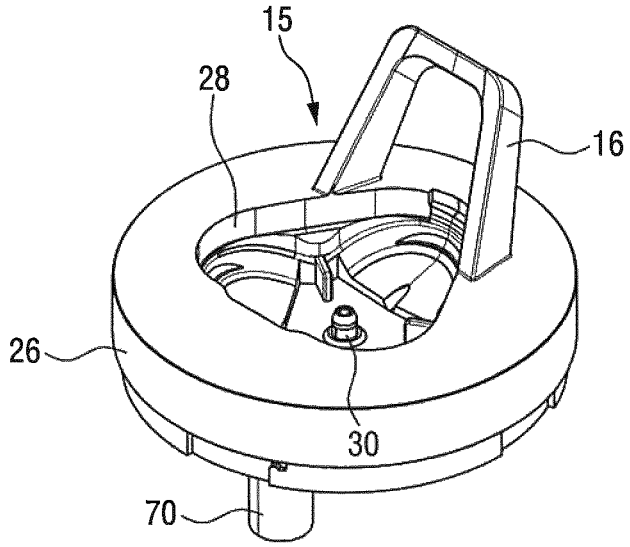
FIG. 11 again shows the upper housing portion of the cleaning device of FIG. 1 in perspective view.
Figure 12:
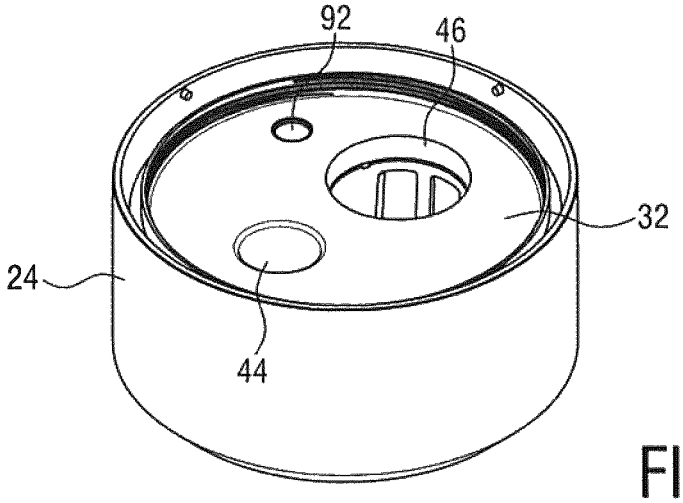
FIG. 12 shows the associated lower housing portion with the cartridge inserted in the lower housing portion, so that the upper housing portion as shown in FIG. 11 can be placed thereon.

In FIG. 12 the lower housing portion 24 is shown, with the cartridge 32 arranged in the lower housing portion 24, in a position below the associated upper housing portion 26 shown in FIG. 11.

As can be seen in FIGS. 3 and 4, in the upper housing portion 26, below the top wall 66 thereof and enclosed by an annular side wall 64 and a bottom wall 68, there is formed a basin 36 into which cleaning fluid can be pumped from the cartridge 32. Within the top wall 34 of the cartridge 32 there is one smaller cavity 44 (see FIGS. 9 and 4) and one larger cavity 46 that both extend downwardly from the top wall 34 of the cartridge 32 towards the bottom of the cartridge 32. The first smaller cavity 44 is surrounded by a cone-shaped wall 45. The second larger cavity 46 within the cartridge 32 is surrounded by a substantially cylindrical pump receptacle 61 that extends from the top wall 34 of the cartridge 32 towards the bottom thereof and that includes lateral suction openings 54, 56.

From the bottom wall 68 of the upper housing portion 26 there protrudes a pipe stud 70 into the cone-shaped first cavity 44 of the cartridge 32.

From the bottom wall 68 of the upper housing portion 26 there further protrudes a fluid pumping unit 48 downwardly into the pump receptacle 61 of the cartridge. The fluid pumping unit 48 is surrounded by a pump housing 52 and includes a pinion 58 that reaches downwardly and that drives a pump impeller 60 attached at the lower end thereof.

The driven coupling member 30 is coupled to the fluid pumping unit 48 by means of a drive unit 50 transferring a rotating motion of the driven coupling member 30 onto the pinion 58 of the fluid pumping unit 48.

Thus, when the driven coupling member 30 is driven by the shaving device 12, then the pinion 58 of the fluid pumping unit 48 is driven via the drive unit 50. Thus the pump impeller 60 is rotated so as to draw cleaning fluid through the suction openings 54, 56 and to pass it through a feed channel 62 upwardly into the receiving space 28 for cleaning the shaving unit of the shaving device 12.

Figure 5:
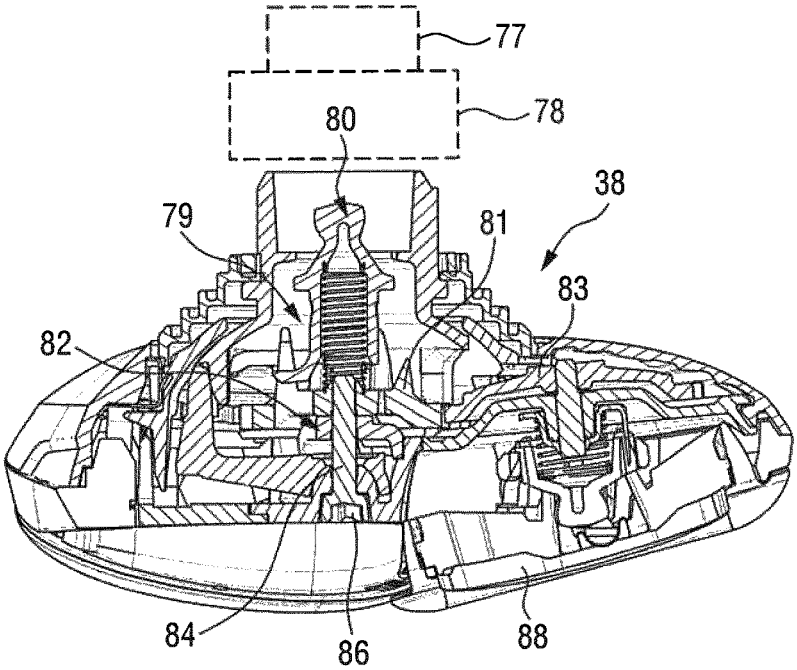
FIG. 5 shows an enlarged cross-section of the shaving unit together with an associated electric actuator and a first drive unit of the shaving device of FIG. 1.

At the center of the receiving space 28 there is the driven coupling member 30 that includes a protrusion 76 (see FIG. 4) protruding upwardly that is mated to a respective driving coupling member 82 provided on the shaving unit 38 (see FIGS. 3 and 5).

When the shaving device 12 is placed correctly on the cleaning device 14 in the cleaning position, then the driving coupling member 82 will be coupled by a rotational connection with the driven coupling member 30 arranged at the center of the receiving space 28.

If the coupling is effected between the shaving device 12 and the cleaning device 14 in the cleaning position, then the driven coupling member 30 drives the fluid pumping unit 48 via the drive unit 50. In this case cleaning fluid is sucked through the suction openings 54, 56 by the pump impeller 60 and is fed through the feed channel 62 into the receiving space 28 to clean the shaving unit 38. During the pumping operation the cleaning fluid, that is circulated around the shaving unit 38 for cleaning it, is contained within the basin 36 and flows back into the interior of the cartridge 32 through the pipe stud 70 and through another, smaller cavity 92 extending from the top wall 34 of the cartridge 32 down towards the bottom thereof (see FIG. 9).

Figure 6:
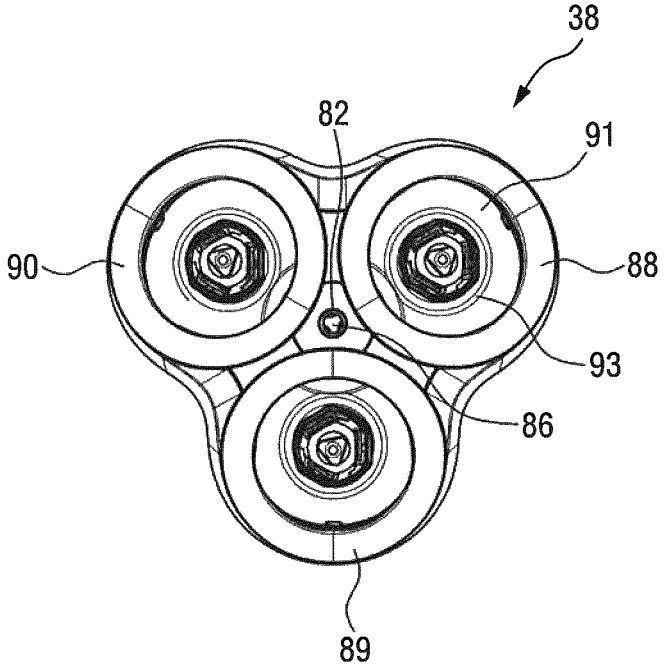
FIG. 6 shows an enlarged top view of the shaving unit of the shaving device of FIG. 1 with three hair-cutting units in a first configuration with a centrally arranged driving coupling member.

The shaving unit 38 of the shaving device 12 comprises three hair cutting units 88, 89, 90 as shown in FIG. 6. Each hair-cutting unit 88, 89, 90 comprises an external cutting member 91 and a respective internal cutting member (not visible and only schematically indicated in FIG. 6 with reference numeral 93). The internal cutting members 93 are rotatable relative to the external cutting members 91 to effect cutting of hairs.

The shaving unit 38 according to FIG. 5 is driven by an electric actuator only indicated in dashed lines by reference numeral 77. The electric actuator 77 drives a first drive unit 78 also indicated in FIG. 5 only by dashed lines. The electric actuator 77 and the first drive unit 78 are accommodated in the handle-shaped main housing 94 of the shaving device 12 (see FIG. 13). The first drive unit 78 is coupled to a coupling structure 80 of the shaving unit 38 via a suitable coupling member by a rotational fit. The shaving unit 38 comprises a second drive unit 79 that is coupled by the coupling structure 80 to the first drive unit 78 contained within the main housing 94 of the shaving device 12. The second drive unit 79 comprises a driving gear wheel 81 which is centrally arranged relative to the three hair-cutting units 88, 89, 90 and engages a respective driven gear wheel 83 of each of the hair cutting units 88, 89, 90 (see FIG. 5). The coupling structure 80 that drives the second drive unit 79 accommodates a central drive shaft 84 that mutually couples the driving gear wheel 81 and the first drive unit 78. The driving coupling member 82 is connected to the driving gear wheel 81 such as to be rotatable together with the driving gear wheel 81 about a common axis of rotation.

The central drive shaft 84 at its outer end comprises a recess 86 (see FIG. 5). The recess 86 is mated to the protrusion 76 at the top end of the driven coupling member 30 of the cleaning device 14 (see FIG. 4) to effect a positive rotational coupling between the protrusion 76 and the recess 86.

Figure 7:
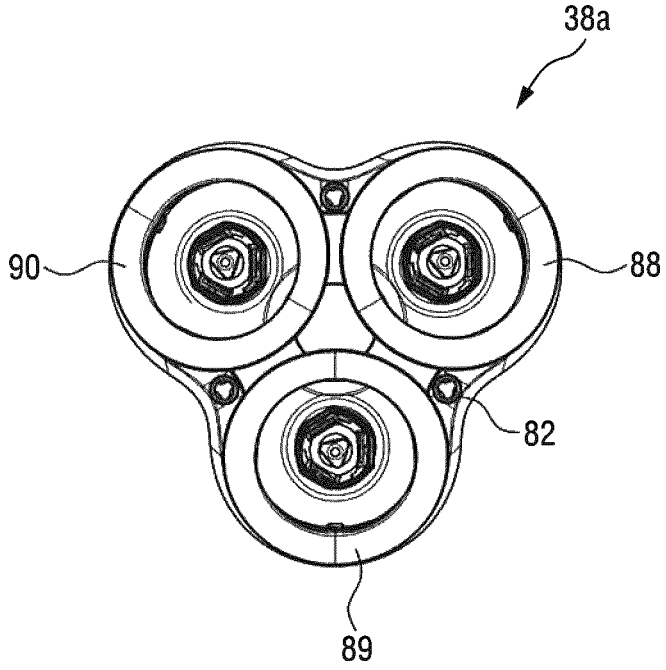
FIG. 7 shows three alternative embodiments of the shaving unit of the shaving device of FIG. 1, in particular three different alternative off-center positions for the driving coupling member.

While the central arrangement of the driving coupling member 82 is shown in FIGS. 5 and 6, it is also possible to arrange the driving coupling member 82 off-center, as shown in FIG. 7. In the shaving unit 38*a* according to FIG. 7 three alternatively possible locations for the driving coupling member 82 are shown close to the outer periphery between adjacent hair cutting units 88, 89, 90.

When the shaving device 12 is placed in the cleaning position on the support structure 15 as shown in FIG. 1, the driving coupling member 82 is coupled to the driven coupling member 30 provided on the cleaning device 14. Thus the fluid pumping unit 48 can be driven by the drive unit 50 so that the pump impeller 60 is rotated so as to draw cleaning fluid through the suction openings 54, 56 and to pass it through the feed channel 62 into the receiving space 28 for cleaning the hair-cutting units 88, 89, 90.

The cartridge 32 is configured as a consumer replaceable part and will usually be replaced after a certain number of cleaning operations. To this end the upper housing portion 26 is removed from the lower housing portion 24 (see FIG. 11, 12), then the cartridge 32 can be removed from the lower housing portion 24 (see FIGS. 9, 10) and can be replaced by a new cartridge 32. In FIG. 4 suitable sealings 74 are shown between an annular rim 72 of the cartridge 32 and the upper housing portion 26 to effect a sealing between the cartridge 32 and the upper housing portion 26.

Figure 13:
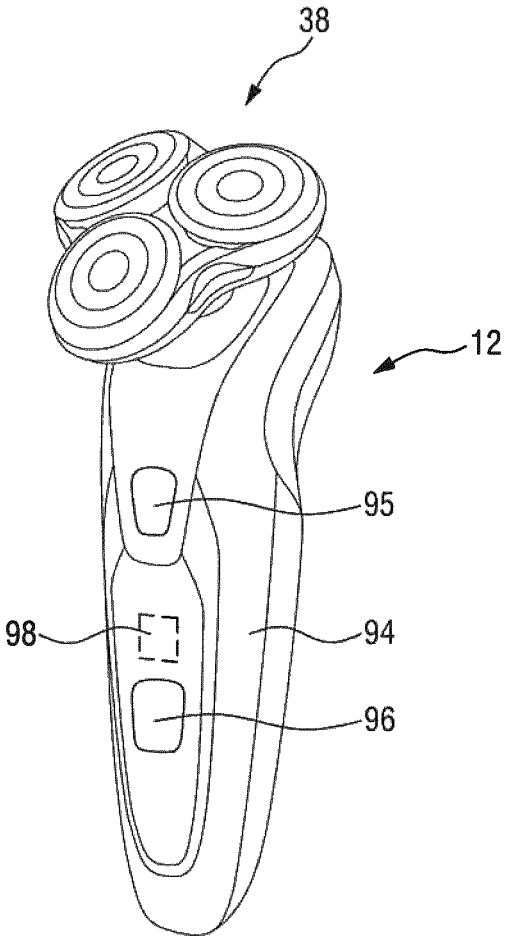
FIG. 13 shows a perspective view of the shaving device of the shaving system according to FIG. 1.

The shaving device 12 according to FIG. 13 includes an on-off switch 95 as well as a control unit 98 and a user interface 96 that may be configured as a soft-touch switch.

The control unit 98 may be programmed by a software program that automatically starts a cleaning procedure when the shaving device 12 is placed onto the supporting structure 15 of the cleaning device 14 in the correct position. The correct position will be detected by the detector 20 cooperating with the detector activating means 18.

As an alternative, a cleaning operation may be initiated by a user via the user interface 96.

Figure 14:
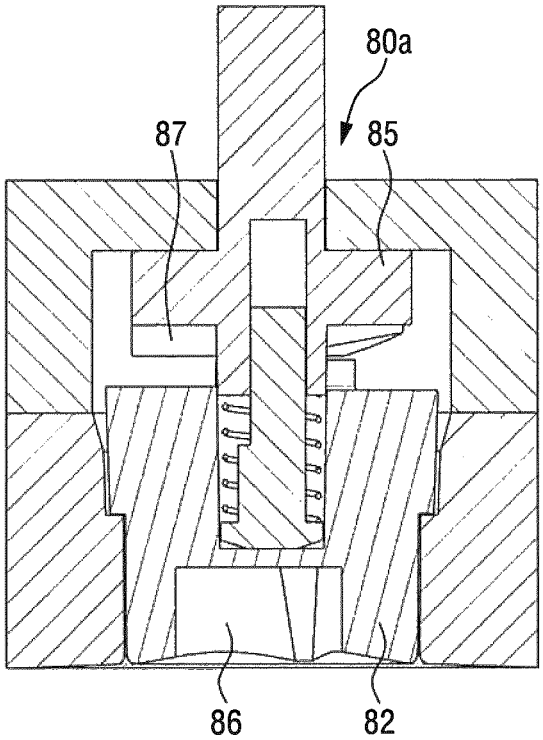
FIG. 14 shows a schematic representation of an alternative coupling structure of the shaving device of FIG. 13 that ensures that the driving coupling member is driven only when the shaving device is arranged in the cleaning device in the cleaning position, shown in a non-coupled position.

FIG. 14 shows a schematic representation of an alternative coupling structure denoted in total with 80*a*, that ensures that the driving coupling member 82 is driven only when the shaving device 12 is coupled to the cleaning device 14 in the cleaning position. The coupling structure 80*a* comprises an intermediate coupling member 85 that comprises a catch member 87 cooperating with the driven coupling member 82 under the action of a spring member. In the non-coupled position shown in FIG. 14 the catch member 87 is not coupled with the driving coupling member 82. Thus in this position the driving coupling member 82 does not rotate, even when the intermediate coupling member 85 rotates.

Figure 15:
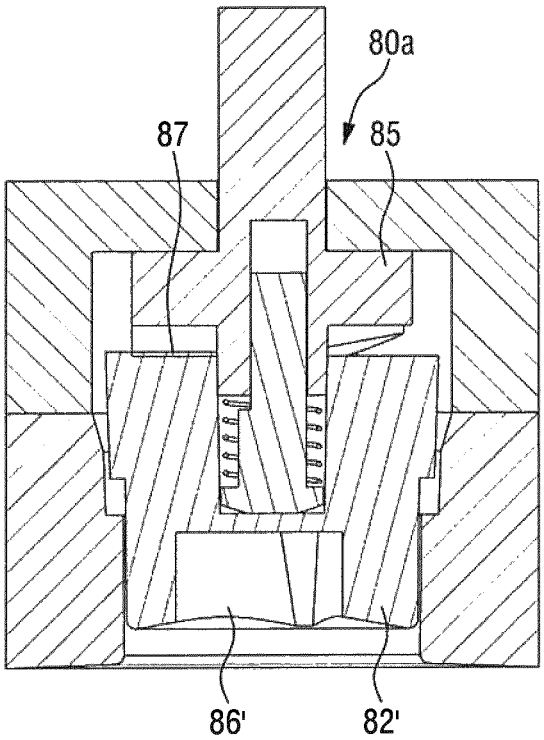
FIG. 15 shows the coupling structure according to FIG. 14 in a coupled position, when the shaving device is in the cleaning position.

FIG. 15 shows the coupling structure 80*a* in the coupled position, when the shaving device 12 is placed on the cleaning device 14 in the cleaning position. In this case the driven coupling member 82 is pressed against the action of the spring member towards the intermediate coupling member 85, so that the catch member 87 engages with the driven coupling member 82, so that the latter rotates when the coupling structure 80*a* rotates.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

| Reference List File No: 4046F2258EP1 | |
|---|---|
| 1 | |
| 2 | |
| 3 | |
| 4 | |
| 5 | |
| 6 | |
| 7 | |
| 8 | |
| 9 | |
| 10 | shaving system |
| 11 | |
| 12 | shaving device |
| 13 | |
| 14 | cleaning device |
| 15 | supporting structure |
| 16 | rest |
| 17 | |
| 18 | detector activating means |
| 19 | |
| 20 | detector |
| 21 | |
| 22 | housing |
| 23 | |
| 24 | lower housing portion |
| 25 | |
| 26 | upper housing portion |
| 27 | |
| 28 | receiving space |
| 29 | bottom wall of receiving space |
| 30 | driven coupling member |
| 31 | |
| 32 | cartridge |
| 33 | |
| 34 | top wall of cartridge |
| 35 | |
| 36 | basin |
| 37 | |
| 38 | shaving unit |
| 39 | |
| 40 | |
| 41 | |
| 42 | sidewall |
| 43 | |
| 44 | cavity |
| 45 | cone-shaped wall |
| 46 | cavity |
| 47 | |
| 48 | fluid pumping unit |
| 49 | |
| 50 | third drive unit |
| 51 | |
| 52 | pump housing |
| 53 | |
| 54 | suction opening |
| 55 | |
| 56 | suction opening |
| 57 | |
| 58 | pinion |
| 59 | |
| 60 | pump impeller |
| 61 | pump receptacle |
| 62 | feed channel |
| 63 | |
| 64 | sidewall |
| 65 | |
| 66 | top wall |
| 67 | |
| 68 | bottom wall |
| 69 | |
| 70 | pipe stud |
| 71 | |
| 72 | annular rim |
| 73 | |
| 74 | sealing |
| 75 | |
| 76 | protrusion |
| 77 | electric actuator |

-continued

| Reference List File No: 4046F2258EP1 | |
|---|---|
| 78 | first drive unit |
| 79 | second drive unit |
| 80, 80a | coupling structure |
| 81 | driving gear wheel |
| 82 | driving coupling member |
| 83 | driven gear wheel |
| 84 | central drive shaft |
| 85 | intermediate coupling member |
| 86 | recess |
| 87 | catch member |
| 88 | hair-cutting unit |
| 89 | hair-cutting unit |
| 90 | hair-cutting unit |
| 91 | external cutting member |
| 92 | opening |
| 93 | internal cutting member |
| 94 | main housing (handle) |
| 95 | on-off switch |
| 96 | switch for cleaning program/user interface |
| 97 | |
| 98 | control unit |
| 99 | |
| 100 | |
| 101 | |
| 102 | |
| 103 | |
| 104 | |
| 105 | |
| 106 | |
| 107 | |
| 108 | |
| 109 | |
| 110 | |
| 111 | |
| 112 | |
| 113 | |
| 114 | |
| 115 | |
| 116 | |

The invention claimed is:

1. A shaving system comprising a shaving device and a cleaning device, wherein:

the shaving device comprises a main housing and a shaving unit coupled to the main housing, said main housing accommodating an electric actuator and a first drive unit drivable by the electric actuator, said shaving unit comprising at least one hair-cutting unit and a second drive unit coupled to the first drive unit and to the hair-cutting unit such that the hair-cutting unit is drivable by the electric actuator via the first and second drive units;

the cleaning device comprises a supporting structure for supporting the shaving device, and a receiving space for receiving the shaving unit when the shaving device is arranged in a cleaning position supported by the supporting structure; and the cleaning device comprises a reservoir for containing a cleaning liquid and a fluid pumping unit for transporting the cleaning liquid from the reservoir to the receiving space;

characterized in that:

the shaving device comprises a driving coupling member which is accessible from an outside of the shaving device and drivable by the shaving device;

the cleaning device comprises a driven coupling member which is accessible from an outside of the cleaning device, and a third drive unit coupled to the driven coupling member and to the fluid pumping unit such that the fluid pumping unit is drivable by the driven coupling member; and the driving coupling member and the driven coupling member are arranged such that, in the cleaning position of the shaving device, the driven coupling member is coupled to the driving coupling member such that the fluid pumping unit is drivable by the driving coupling member.

2. The shaving system as claimed in claim 1, wherein the driving coupling member is drivable by the electric actuator.

3. The shaving system as claimed in claim 2, wherein the driving coupling member is arranged in the shaving unit and coupled to the second drive unit such that the driving coupling member is drivable by the electric actuator via the first and second drive units.

4. The shaving system as claimed in claim 3, wherein the shaving unit comprises at least two hair-cutting units each having an external cutting member and an internal cutting member which is rotatable relative to the external cutting member, and wherein the driving coupling member is arranged centrally between the at least two hair-cutting units.

5. The shaving system as claimed in claim 4, wherein the shaving unit comprises three hair-cutting units each having an external cutting member and an internal cutting member which is rotatable relative to the external cutting member, wherein the three hair-cutting units are mutually arranged in a triangular configuration and wherein the driving coupling member is arranged centrally between the three hair-cutting units.

6. The shaving system as claimed in claim 1, wherein the driving coupling member is only driveable when the shaving device is in the cleaning position.

7. The shaving system as claimed in claim 1, wherein the shaving device comprises a control unit configured and arranged for controlling the driving of the driving coupling member according to a driving program.

8. The shaving system as claimed in claim 7, wherein the shaving device comprises a user interface coupled to the control unit by means of which a user of the shaving system can activate the driving program.

9. The shaving system as claimed in claim 7, wherein the shaving device comprises a detector coupled to the control unit for detecting the cleaning position, and wherein the control unit is configured and arranged to activate the driving program after detection of the cleaning position by the detector.

10. The shaving system as claimed in claim 1, wherein the driven coupling member is arranged in the receiving space.

11. The shaving system as claimed in claim 10, wherein the driven coupling member is arranged centrally in a bottom wall of the receiving space.

12. The shaving system as claimed in claim 1, wherein the reservoir is replaceable.

13. The shaving system as claimed in claim 12, wherein the cleaning device comprises a lower housing portion and an upper housing portion detachably coupled to the lower housing portion, wherein the reservoir is arranged in the lower housing portion and accessible for replacement by removing the upper housing portion from the lower housing portion, and wherein the supporting structure, the receiving space, the driven coupling member and the fluid pumping unit are arranged in the upper housing portion.

14. The shaving system as claimed in claim 13, wherein the drive unit and the fluid pumping unit are arranged in the upper housing portion.

15. The shaving system as claimed in claim 1, wherein the reservoir is integrally formed with the cleaning device.

16. The shaving system as claimed in claim 1, wherein the shaving unit comprises three hair-cutting units each having an external cutting member and an internal cutting member which is rotatable relative to the external cutting member, wherein the three hair-cutting units are mutually arranged in a triangular configuration and wherein the driving coupling member is arranged centrally between the three hair-cutting units such that the driving coupling member is accessible from the outside of the shaving unit.

17. The shaving system as claimed in claim 1, wherein:

the shaving unit is coupled to the main housing by means of a coupling structure;

the second drive unit comprises a driving gear wheel which is centrally arranged relative to the at least two hair-cutting units to engage a respective driven gear wheel of each of the hair-cutting units;

the coupling structure accommodates a central drive shaft mutually coupling the driving gear wheel and the first drive unit; and the driving coupling member is connected to the driving gear wheel such as to be rotatable together with the driving gear wheel about a common axis of rotation.

* * * * *